US007510011B2

(12) United States Patent
Le Gloahec et al.

(10) Patent No.: US 7,510,011 B2
(45) Date of Patent: Mar. 31, 2009

(54) WELL SERVICING METHODS AND SYSTEMS EMPLOYING A TRIGGERABLE FILTER MEDIUM SEALING COMPOSITION

(75) Inventors: Ronan Le Gloahec, Dubai (AE); John E. Edwards, Ruwi (OM)

(73) Assignee: Schlumberger Technology Corporation, Sugar Land, TX (US)

( * ) Notice: Subject to any disclaimer, the term of this patent is extended or adjusted under 35 U.S.C. 154(b) by 215 days.

(21) Appl. No.: 11/428,985

(22) Filed: Jul. 6, 2006

(65) Prior Publication Data

US 2008/0006413 A1 Jan. 10, 2008

(51) Int. Cl.
*E21B 43/00* (2006.01)

(52) U.S. Cl. ..... 166/369; 166/228; 166/230

(58) Field of Classification Search ..... 166/369, 166/227, 228, 230, 236
See application file for complete search history.

(56) References Cited

U.S. PATENT DOCUMENTS

| | | | |
|---|---|---|---|
| 2,931,089 | A | 4/1960 | Evans |
| 2,945,451 | A | 7/1960 | Griswold |
| 2,958,593 | A | 11/1960 | Hoover et al. |
| 3,385,367 | A | 5/1968 | Kollsman |
| 3,537,121 | A | 11/1970 | McAvoy |
| 3,595,738 | A | 7/1971 | Clarke et al. |
| 3,619,874 | A | 11/1971 | Li et al. |
| 3,831,676 | A | 8/1974 | Brown et al. |
| 3,868,749 | A | 3/1975 | Cate |
| 3,951,210 | A | 4/1976 | Wu et al. |
| 3,952,804 | A | 4/1976 | Smyrl |
| 3,974,877 | A | 8/1976 | Redford |
| 3,983,941 | A | 10/1976 | Fitch |
| 4,085,802 | A | 4/1978 | Sifferman et al. |

(Continued)

FOREIGN PATENT DOCUMENTS

| | | |
|---|---|---|
| GB | 247593 | 1/1927 |

(Continued)

OTHER PUBLICATIONS

Omanexpo LLC.: "PDO Notches Gains in Dealing With 'Produced Water'," Market Report (2005), Oman Observer, Jun. 2005, p. 14.
Schlumberger.: "Services to Support the Management of Oilfield Water," Brochure, Water Solutions, Sep. 2002, 7 pages.

(Continued)

*Primary Examiner*—William P Neuder
(74) *Attorney, Agent, or Firm*—Jeremy P. Welch; Bryan P. Galloway; Tim Curington

(57) ABSTRACT

Well servicing methods and systems are described, in one embodiment comprising installing a tool in a wellbore, the tool comprising a base tubular having a plurality of openings and a longitudinal bore adapted to fluidly connect to a tubular; a jacket tubular having a second plurality of openings; and an open, lofty, three-dimensional, non-fines stopping fibrous filter medium between the base tubular and the jacket tubular; and installing a first packer upstream of the tool and a second packer downstream of the tool. In some embodiments a sealant precursor composition may be fixed to the fibers. The sealant precursor composition may be activated to form a seal by a triggering chemical composition. This abstract allows a searcher or other reader to quickly ascertain the subject matter of the disclosure. It may not be used to interpret or limit the scope or meaning of the claims. 37 CFR 1.72(b).

22 Claims, 4 Drawing Sheets

U.S. PATENT DOCUMENTS 4,088,580 A 5/1978 Spurlock
4,102,399 A 7/1978 Harnsberger
4,120,359 A 10/1978 Harnsberger
4,176,420 A 12/1979 Magid
4,193,453 A 3/1980 Golinkin
4,232,740 A 11/1980 Park
4,291,766 A 9/1981 Davies et al.
4,378,845 A 4/1983 Medlin et al.
4,427,069 A 1/1984 Friedman
4,494,605 A 1/1985 Wiechel et al.
4,532,994 A 8/1985 Toma et al.
4,549,608 A 10/1985 Stowe et al.
4,669,543 A 6/1987 Young
4,681,163 A 7/1987 Guidry et al.
4,683,949 A 8/1987 Sydansk et al.
4,685,519 A 8/1987 Stowe et al.
4,693,318 A 9/1987 Petrovic
4,700,776 A 10/1987 Petrovic
4,811,790 A 3/1989 Jennings
4,862,967 A 9/1989 Harris
4,893,439 A 1/1990 McAvoy et al.
5,082,720 A 1/1992 Hayes
5,101,900 A 4/1992 Dees
5,101,901 A 4/1992 Shu et al.
5,145,013 A 9/1992 Dees et al.
5,199,491 A 4/1993 Kutta et al.
5,199,492 A 4/1993 Surles et al.
5,211,235 A 5/1993 Shu et al.
5,211,236 A 5/1993 Shu
5,222,557 A 6/1993 Shu et al.
5,246,073 A 9/1993 Sandiford et al.
5,256,729 A 10/1993 Kutta et al.
5,287,923 A 2/1994 Cornette et al.
5,287,930 A 2/1994 McGill
5,310,000 A 5/1994 Arterbury et al.
5,320,178 A 6/1994 Cornette
5,335,733 A 8/1994 Sandiford et al.
5,343,948 A 9/1994 Shu
5,355,956 A 10/1994 Restarick
5,363,917 A 11/1994 Jennings et al.
5,431,225 A 7/1995 Abass et al.
5,435,389 A 7/1995 Shu et al.
5,486,312 A 1/1996 Sandiford et al.
5,497,658 A 3/1996 Fletcher et al.
5,505,260 A 4/1996 Andersen et al.
5,547,023 A 8/1996 McDaniel et al.
5,551,514 A 9/1996 Nelson et al.
5,617,920 A 4/1997 Dovan et al.
5,642,781 A 7/1997 Richard
5,712,314 A 1/1998 Surles et al.
5,730,223 A 3/1998 Restarick
5,782,299 A 7/1998 Simone et al.
5,783,526 A 7/1998 Dobson et al.
5,806,593 A 9/1998 Surles
5,829,522 A 11/1998 Ross et al.
5,836,391 A 11/1998 Jonasson et al.
5,841,131 A 11/1998 Schroeder et al.
5,899,271 A 5/1999 Simone et al.
5,937,944 A 8/1999 Simone et al.
5,938,925 A 8/1999 Hamid et al.
5,947,644 A 9/1999 Gibbons et al.
RE36,466 E 12/1999 Nelson et al.
6,011,075 A 1/2000 Parris et al.
6,047,773 A 4/2000 Zeltmann et al.
6,092,604 A 7/2000 Rice et al.
6,109,349 A 8/2000 Simone et al.
6,125,932 A 10/2000 Hamid et al.
6,283,214 B1 9/2001 Guinot et al.
6,343,651 B1 2/2002 Bixenman
6,364,019 B1 4/2002 Aggour et al.
6,431,278 B1 8/2002 Guinot et al.
6,446,729 B1 9/2002 Bixenman et al.
6,450,260 B1 9/2002 James et al.
6,498,988 B1 12/2002 Robert et al.
6,513,599 B1 2/2003 Bixenman et al.
6,543,545 B1 4/2003 Chatterji et al.
6,607,037 B2 8/2003 Thompson
6,622,794 B2 9/2003 Zisk, Jr.
6,632,778 B1 10/2003 Ayoub et al.
6,634,431 B2 10/2003 Cook et al.
6,681,854 B2 1/2004 Danos
6,719,051 B2 4/2004 Hailey, Jr. et al.
6,719,064 B2 4/2004 Price-Smith et al.
6,722,437 B2 4/2004 Vercaemer et al.
6,749,024 B2 6/2004 Bixenman
6,749,025 B1 6/2004 Brannon et al.
6,752,206 B2 6/2004 Watson et al.
6,766,857 B2 7/2004 Bixenman et al.
6,766,862 B2 7/2004 Chatterji et al.
6,799,645 B2 10/2004 Mason et al.
6,820,690 B2 11/2004 Vercaemer et al.
6,827,144 B2 12/2004 Nicholson
6,830,104 B2 12/2004 Nguyen et al.
6,834,725 B2 12/2004 Whanger et al.
6,840,325 B2 1/2005 Stephenson
6,848,505 B2 2/2005 Richard et al.
6,854,522 B2 2/2005 Brezinski et al.
6,857,476 B2 2/2005 Richards
6,886,634 B2 5/2005 Richards
6,899,176 B2 5/2005 Hailey, Jr. et al.
6,907,930 B2 6/2005 Cavender et al.
6,994,170 B2 2/2006 Echols
2002/0033259 A1 3/2002 Watson et al.
2002/0053439 A1 5/2002 Danos
2002/0074119 A1 6/2002 Bixenman et al.
2002/0092648 A1 7/2002 Johnson et al.
2003/0089495 A1 5/2003 Bixenman
2003/0146003 A1 8/2003 Duggan et al.
2003/0168216 A1 9/2003 Nicholson
2004/0060695 A1* 4/2004 Castano-Mears et al. .... 166/228
2004/0118572 A1 6/2004 Whanger et al.
2004/0123983 A1 7/2004 Cook et al.
2004/0129418 A1 7/2004 Jee et al.
2004/0163819 A1 8/2004 Johnson et al.
2005/0072576 A1 4/2005 Henriksen et al.
2005/0072579 A1 4/2005 Gambier
2007/0289741 A1* 12/2007 Rambow ..... 166/250.01

FOREIGN PATENT DOCUMENTS

GB 2022653 A 12/1979
GB 2404397 A 2/2005
WO 9853180 A1 11/1998
WO 02020941 A1 3/2002
WO 02059452 A1 9/2002
WO 03008756 A1 1/2003
WO 03056125 A2 7/2003
WO 2004005665 A2 1/2004
WO 2004005669 A1 1/2004
WO 2004018836 A1 3/2004
WO 2004022911 A3 3/2004
WO 2004027209 A1 4/2004
WO 2004057715 A3 7/2004
WO 2004101952 A1 11/2004
WO 2005012686 A1 2/2005
WO 2005056977 A1 6/2005
WO 2006003112 A1 1/2006

OTHER PUBLICATIONS

Schlumberger.: "MeshRite Screens," Brochure, Jan. 2004, 2 pages.
Harthy, Aziz and Schrama, Erik.: "(Low Cost) Completions in Oman," Presentation, ShellEP Technology, May 2005, 20 pages.

* cited by examiner

WELL SERVICING METHODS AND SYSTEMS EMPLOYING A TRIGGERABLE FILTER MEDIUM SEALING COMPOSITION

BACKGROUND OF THE INVENTION

1. Field of Invention

The present invention relates generally to the field of well servicing of oil and gas wells, and more particularly to methods and systems useful in both cased and open hole sand face completions.

2. Related Art

The production of hydrocarbon from reservoirs requires permanently installed wellbores in the ground composed of a multiplicity of largely tubular structures referred to as the wellbore completion. Increasing the production of hydrocarbon typically requires the pumping of a fluid down the wellbore and into the reservoir, or through separate reinjection wells. Some fluids are designed to increase the flow of hydrocarbon, others impede the flow of water or build-up of scale.

Some operators and owners have reported significant gains in their ongoing efforts to deal with copious amounts of water produced along with oil from various reservoirs. In some instances, nearly seven barrels of water may be produced for every barrel of crude oil. The rate at which the produced-water volume is growing may be slowed through the use of various technologies. One notable success involves the use of expandable zonal inflow profiler (EZIP) technology to reduce 'produced water'. The EZIP is a type of well completion that, when placed in contact with water inside a borehole, swells to provide a strong seal, and thus prevents the water from entering the well.

Many sandface completions installed today for reservoirs of this nature use systems consisting of wire-wrap screens and a series of blank casing pipes and EZIP annular packers. The typical length of completion segments between open-hole EZIP annular packers is about 100 m, with two or more 10 m screens distributed amongst blank casing pipes along this 100 m. Water shut off techniques in these systems span the range of mechanical and chemical treatments. One mechanical water shut off treatment typically used is a through-tubing casing patch, while chemical treatments include polymeric gels, many of which are crosslinked and may be delayed action.

Despite available water shut off techniques, improved methods and systems are needed that reduce the plugging inherent in wire-wrap screens, and that may be applied at any time in the life cycle of a reservoir or field to enhance the value of oil and gas assets through reduced water handling cost, improved hydrocarbon productivity and/or higher recovery factors.

SUMMARY OF THE INVENTION

In accordance with the present invention, well servicing methods and systems for carrying out the methods are described that reduce or overcome problems in previously known methods and systems for shutting off water-productive zones in reservoirs and fields. By "well servicing", we mean any operation designed to increase hydrocarbon recovery from a reservoir, reduce non-hydrocarbon recovery (when non-hydrocarbons are present), or combinations thereof, involving the step of triggering a sealant precursor composition to form, a seal. This includes pumping fluid into a wellbore and into an injector well and recovering the hydrocarbon from a wellbore. As used here in the phrases "treatment" and "servicing" are thus broader than "stimulation."

A first aspect of the invention are methods, one method comprising:

(a) installing a tool in a wellbore, the tool comprising:

- a base tubular having a plurality of openings and a longitudinal bore adapted to fluidly connect to a tubular;
- a jacket tubular having a second plurality of openings; and
- an open, lofty, three-dimensional, non-fines stopping fibrous filter medium between the base tubular and the jacket tubular; and (b) installing a first packer upstream of the tool and a second packer downstream of the tool.

Methods in accordance with this aspect include producing hydrocarbon through the tool, and methods wherein the fibrous filter medium comprises a porous nonwoven steel fiber article and a sealant precursor composition fixed either to the fibers, in at least some regions between the fibers, or combination thereof. The methods may comprise triggering the sealant precursor composition, or a component thereof, to seal at least a face of the fibrous filter medium when desired. Triggering may comprise any one or more techniques, such as mechanical, physical, chemical, thermal, and the like. If the triggering mechanism is chemical, the method may comprise flowing one or more triggering compositions into the wellbore to trigger the sealant precursor composition into forming a seal. The methods may comprise removing two or more wire screen tools per 100 m length, the wire screen tools separated by blank pipes, with one tool comprising a base tubular, a jacket tubular, and an open, lofty, three-dimensional, non-fines stopping fibrous filter medium. Either one or both packers may be water-swellable expandable zonal inflow profiler packers.

Methods of the invention include those wherein the triggering occurs when a) an unacceptable amount of water is detected at or near the fibrous filter medium; b) when an unacceptable amount of water begins producing from the wellbore; c) a combination of (a) and (b); or for any other reason. The phrase "unacceptable amount of water" is determined on a case by case basis. As used herein the phrase "sealant precursor composition" means a composition that is substantially inert to any produced fluids (gases and liquids) and other fluids injected in to the wellbore or around the wellbore, such as workover fluids, and which is able to be triggered into sealing at least a face of the fibrous filter medium. The sealant precursor composition may itself be triggered, or a sealing component of the sealant precursor composition may be triggered to form the seal. The terms "triggering" and "triggered" as used herein include any physical, chemical, thermal and other means to activate, initiate, catalyze, or otherwise awaken or cause the sealant precursor composition itself or a sealing component thereof to transform from a substantially inert composition to a sealing composition. As used herein the terms "seal" and "sealing" mean at least the ability to substantially prevent fluids comprising an unacceptable amount of water to flow through the fibrous filter medium and be produced through the wellbore completion. These terms may also mean the ability to substantially prevent fluids from flowing between the filter medium and whatever surface it is sealing against, for example an open hole, a sand face, a casing pipe, and the like. A "wellbore" may be any type of well, including, but not limited to, a producing well, a non-producing well, an injection well, a fluid disposal well, an experimental well, an exploratory well, and the like. Wellbores may be vertical, horizontal, deviated some angle between vertical and horizontal, and combinations thereof, for example a vertical well with a non-vertical component. "Tubular" and "tubing" refer to a conduit or any kind of a round hollow apparatus in general, and in the area of oilfield applications to casing, drill pipe, metal tube, or coiled tubing or other such apparatus.

Methods of the invention include those wherein the triggering mechanism is primarily chemical in nature, and comprises conveying a triggering composition to the filter medium via coiled tubing, with or without a communication line, such as a slickline, micro-line, or micro-wire, accompanying the coiled tubing, either attached to the outside of the coiled tubing, or disposed inside the coiled tubing. The triggering composition may itself trigger the sealant precursor composition or a component thereof to seal, or the triggering composition may comprise a triggering component. The triggering composition, triggering component (if present), sealant precursor composition, and sealing component (if present) may be independently selected from any solids, liquids, gases, and combinations thereof, such as slurries, gas-saturated or non-gas-saturated liquids, mixtures of two or more miscible or immiscible liquids, and the like, as long as the sealant precursor composition (or sealing component therein) is able to be activated by the triggering composition (or triggering component thereof). The triggering composition, triggering component (if present), sealant precursor composition, and sealing component (if present) may be independently selected from organic chemicals, inorganic chemicals, and any combinations thereof; organic chemicals may be monomeric, oligomeric, polymeric, crosslinked, and combinations thereof; polymers may be thermoplastic (including thermoplastic silicones, although strictly speaking these are not organic), thermosetting, moisture setting, elastomeric, and the like, and any of these may comprise one or more inorganic ingredients; inorganic chemicals may be metals, alkaline and alkaline earth chemicals, minerals, and the like. The physical nature of the triggering composition, triggering component (if present), sealant precursor composition, and sealing component (if present) may be independently selected from any morphology that will serve the sealing function as intended, including foamed, gelled, slurried, powdered, and the like. The triggering composition and triggering component (if present) may or may not react with the sealant precursor composition or sealing component (if present) to cause a chemical change of either composition; the only proviso is that the sealant precursor composition alone (but under the influence of the triggering composition), or in reactive or physical combination with the triggering composition, causes or results in the seal.

The fibrous filter media may comprise any fibrous material having porosity sufficient to pass wellbore fluids and treatment fluids therethrough without significant plugging, that does not stop particle fines, and that is capable of serving as a support or base for the sealant precursor composition. The fibrous material may be woven or nonwoven, and may be comprised of organic fibers, inorganic fibers, mixtures thereof and combinations thereof. Further characteristics of the fibrous filter media are provided in the detailed description, but in some embodiments the fibrous filter media may be any of the nonwoven steel mesh filter media known under the trade designation MeshRite™, available from Schlumberger. Whatever fibrous filter media is employed, the media are typically supported on an internal perforated carrier pipe, and may be protected by an external perforated pipe, as further explained herein. The sealant precursor composition may be adhered to the fibers using a separate adhesive composition, coated onto the fibers neat or in combination with a coatable or sprayable binder, magnetically held onto the fibers, or otherwise supported by the fibers of the fibrous filter media in such as way that the sealant precursor composition does not easily come lose from the fibers, but is able to itself interact with, or cause a sealing component of the sealant precursor composition to interact with, the triggering mechanism. Adhesives, coatable binders, and sprayable binders are known for these purposes, and examples are provided herein.

The tool may comprise a base tubular defining the bore, the base tubular having a plurality of openings therein whose size, shape, and configuration maybe varied according to the job at hand. Suitable base tubulars include any of those described and illustrated in U.S. Pat. No. 6,749,024, but the invention is not so limited. The tool may also comprise an outer jacket tubular, also having a plurality of openings. The jacket tubular may include a shroud having alternative flow regions, as described in U.S. Pat. No. 6,681,854.

Methods of the invention include those wherein the installing of the tool comprises using a conveyance line, which may be selected from wireline, slickline, and tubulars, wherein "tubular" and "tubing" refer to a conduit or any kind of a round hollow apparatus in general, and in the area of oilfield applications to casing, drill pipe, production piping, service piping, metal tube, jointed pipe, coiled tubing and the like.

Certain methods of the invention comprise monitoring the status of the wellbore in the vicinity of the fibrous filter medium for an unacceptable amount of water or other condition making desirable the triggering of the sealant precursor composition to form the seal. Such monitoring may employ a communication line, which may be a wire or optical fiber. In embodiments wherein the communication line comprises an optical fiber, exemplary methods of the invention may include diffusing an optical signal using a first optical connector, transmitting the diffused signal through the optical fiber to a second optical connector, and refocusing the signal to the diameter of the optical fiber. The signal may be transmitted through an optical pressure bulkhead in a wall of a housing near the wellbore surface; optionally, optical signals may be transmitted in both directions in duplex fashion through the optical fiber. The signals may be colorimetric, for example, if the sealant precursor composition comes in contact with water, and changes color, the optical fiber may transmit this color change. One or more than one optical fibers may be used. In certain other method embodiments the communication line may be a wire, such as a micro-wire, and an electrical signal may be conveyed to a data acquisition system by means selected from wireless and wire transmission means. A sensor may be attached to a distal end of the communication line, in the case of optical fiber using gratings on the optical fiber, and/or doping the optical fiber, and combinations thereof. The data may be used to monitor status of the fibrous filter medium, or model subsequent applications of triggering conditions. The well treatment operation may comprise at least one adjustable parameter and the methods may include adjusting the parameter. The methods are particularly desirable when the measurement and the conveying of the triggering mechanism or composition are performed in real time. The measured property of conditions at or near the filter medium may be any property that may be measured downhole, including but not limited to pressure, temperature, pH, amount of precipitate, fluid temperature, depth, presence of water, chemical luminescence, gamma-ray, resistivity, salinity, fluid flow, fluid compressibility, tool location, presence of a casing collar locator, tool state and tool orientation. In particular embodiments, the measured property may be a distributed range of measurements across an interval of a wellbore such as across a branch of a multi-lateral well. The parameter being measured may be any parameter that may be adjusted, including but not limited to quantity of triggering composition, relative proportions of each triggering composition in a set of triggering compositions, the chemical concentration of one or more components in a set of triggering compositions, the relative proportion of fluids being pumped in the annulus to fluids being pumped in the coiled tubing, concentration of a catalyst to be released, concentration of a polymer, concentration of proppant, and location of coiled tubing.

Other exemplary method embodiments of the invention are those wherein the triggering composition is driven into the wellbore by a pumping system that pumps one or more fluids into the wellbore. One or more than one fluids may be pumped into the wellbore in succession to trigger the sealant precursor composition. The pumping systems may include mixing or combining devices, wherein fluids, solids, and/or gases maybe mixed or combined prior to being pumped into the wellbore. The mixing or combining device may be controlled in a number of ways, including, but not limited to, using data obtained either downhole from the wellbore, surface data, or some combination thereof. Methods of the invention may include using a surface data acquisition and/or analysis system, such as described in assignee's U.S. Pat. No. 6,498,988, incorporated by reference herein. Certain methods of the invention are those wherein a first triggering fluid is pumped into the wellbore to trigger a first portion of the sealant precursor composition to seal, followed by one or more subsequent fluids to triggered another portion of the sealant precursor composition to seal. The different fluids may differ in terms of composition, concentration, viscosity, temperature, density, ratio of solid to liquid, acidity (pH), and the like. Other embodiments comprise sealing the zone of interest using packers, such as straddle cup packers.

Another aspect of the invention are systems for carrying out the inventive methods, one inventive system comprising:

(a) a wellbore tool comprising (i) a base tubular having a plurality of openings and a longitudinal bore adapted to be fluidly connected to a tubular; (ii) a jacket tubular having a second plurality of openings; and (iii) an open, lofty, three-dimensional, non-fines stopping fibrous filter medium between the base tubular and the jacket tubular; and (b) a downstream and an upstream packer, the packers adapted to isolate the wellbore tool in a zone of a wellbore.

Systems within the invention include those wherein the base and jacket tubulars, the fibrous filter medium, and packers have one or more of the features described in relation to the methods of the invention. As used herein the phrase "fluidly connected" is a general term meaning the component to which the phrase refers may be temporarily or permanently, but in any case securely, attached to another component by means such as flanges, welds, clamps, screwed fittings, and the like, as along as the mechanism of attachment allows fluids to be transferred therethrough without significant fluid leak paths. Some system embodiments of the invention may comprise a communication line, such as an optical fiber or micro-wire. In embodiments wherein the slickline communication line comprises one or more multi-use micro-wires, the micro-wires may comprise materials (Inconel, Monel, and the like) that are not harmed by wellbore fluids, the triggering fluid or by other well treatment fluids.

Systems of the invention may include one or more oilfield tool components. The term "oilfield tool component" includes oilfield tools, tool strings, deployment bars, coiled tubing, jointed tubing, wireline sections, slickline sections, combinations thereof, and the like adapted to be run through one or more oilfield pressure control components. The term "oilfield pressure control component" may include a BOP, a lubricator, a riser pipe, a wellhead, or combinations thereof.

Advantages of the systems and methods of the invention include elimination or reduction in the number of sand screens, such as wire-wrap screens, that may easily plug with sand fines. The open, lofty fibrous filter media described in the present invention by nature do not stop fines from being produced and are resistant to plugging, as opposed to wire-wrap screens. Sealant precursor compositions and triggering mechanisms for creating a seal may be used to control when, where, and how the seal is formed, the morphology of the seal (solid, gelled, etc.) and the thickness of the seal. For example, in some embodiments, only a face of the fibrous filter medium is sealed off, as opposed to placing an annular gel packer using conventional gelled water shut off apparatus.

Systems and methods of the invention may become more apparent upon review of the brief description of the drawings, the detailed description of the invention, and the claims that follow.

BRIEF DESCRIPTION OF THE DRAWINGS

The manner in which the objectives of the invention and other desirable characteristics may be obtained is explained in the following description and attached drawings in which.

Figure 1:
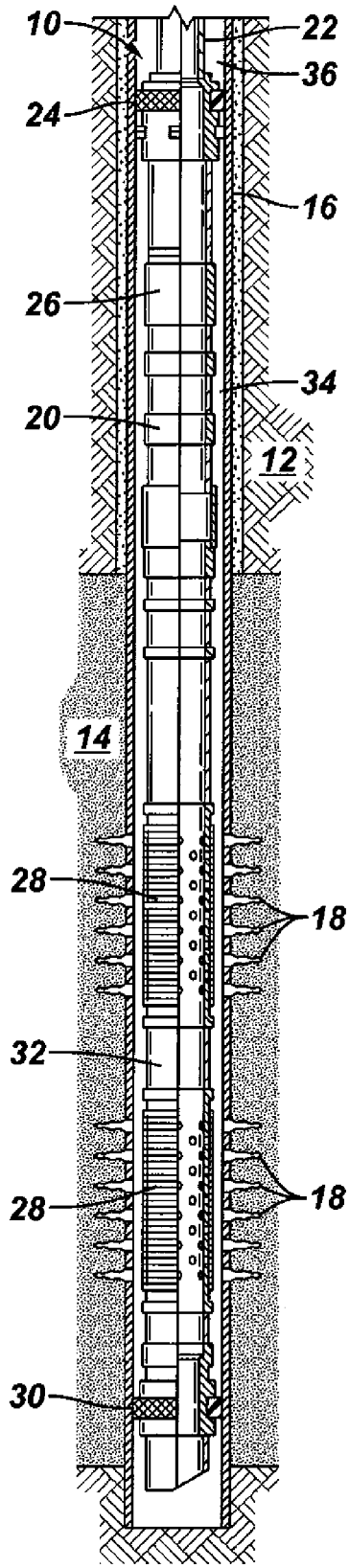
FIG. 1 is a cross section of a wellbore showing a typical completion system using wire-wrap screens of the prior art.

It is to be noted, however, that the appended drawings are not to scale and illustrate only typical embodiments of this invention, and are therefore not to be considered limiting of its scope, for the invention may admit to other equally effective embodiments.

DETAILED DESCRIPTION

In the following description, numerous details are set forth to provide an understanding of the present invention. However, it may be understood by those skilled in the art that the present invention may be practiced without these details and that numerous variations or modifications from the described embodiments may be possible.

All phrases, derivations, collocations and multiword expressions used herein, in particular in the claims that follow, are expressly not limited to nouns and verbs. It is apparent that meanings are not just expressed by nouns and verbs or single words. Languages use a variety of ways to express content. The existence of inventive concepts and the ways in which these are expressed varies in language-cultures. For example, many lexicalized compounds in Germanic languages are often expressed as adjective-noun combinations, noun-preposition-noun combinations or derivations in Romanic languages. The possibility to include phrases, derivations and collocations in the claims is essential for high-quality patents, making it possible to reduce expressions to their conceptual content, and all possible conceptual combinations of words that are compatible with such content (either within a language or across languages) are intended to be included in the used phrases.

The invention describes well servicing methods and systems for use in same that may reduce the use of wire-wrap sand screens, and that may be applied at any time in the life cycle of a reservoir or field to enhance the value of oil and gas assets through reduced water handling cost, improved hydrocarbon productivity and/or higher recovery factors. As used herein the term "field" includes land based (surface and subsurface) and sub-seabed applications. The term "oilfield" as used herein includes hydrocarbon oil and gas reservoirs, and formations or portions of formations where hydrocarbon oil and gas are expected but may ultimately only contain water, brine, or some other composition.

Methods and systems of the invention make use of a wellbore tool comprising (i) a base tubular having a plurality of openings and a longitudinal bore adapted to be fluidly connected to a tubular; (ii) a jacket tubular having a second plurality of openings; and (iii) an open, lofty, three-dimensional, non-fines stopping fibrous filter medium between the base tubular and the jacket tubular. Oilfield tubulars, including so-called perforated tubulars, are well known and required little explanation to the skill oilfield artisan, and are not further discussed except to say that the size, shape and configuration of the perforations or openings may vary within wide limits. Suitable base tubulars include any of those described and illustrated in U.S. Pat. No. 6,749,024, incorporated herein by reference, but the invention is not so limited. The tool may also comprise an outer jacket tubular, also having a plurality of openings. The jacket tubular may include a shroud having alternative flow regions, as described in U.S. Pat. No. 6,681,854, incorporated herein by reference.

Fibrous filter media useful in methods and systems of the invention may comprise any fibrous material having porosity sufficient to pass wellbore fluids and treatment fluids therethrough without significant plugging, that does not stop particle fines, and that is capable of serving as a support or base for a sealant precursor composition, if used. The fibrous material may be woven or nonwoven, and may be comprised of organic fibers, inorganic fibers, mixtures thereof, differing layers thereof, and combinations thereof.

Some embodiments the invention may employ a wellbore tool comprising a combination of base tubular, stainless steel fibrous filter media, and jacket tubular known under the trade designation MeshRite™, available from Schlumberger. Developed after extensive research and field testing, these wellbore screen tools use technology that is fully compatible with all types of sand-control techniques, including open-hole and cased-hole gravel packs, horizontal gravel packs, stand-alone screen deployment, and through-tubing sand-control in oil and gas reservoirs.

The wellbore screen tools known under the trade designation MeshRite™ have heretofore proven useful in the field as cost-effective tools for controlling solids and sand production, and when modified in accordance with the invention to include a sealant precursor composition, are useful as a water shut off device. The screens are rugged and can be handled on the rig site and downhole similarly to tubing and casing. Very low pressure drops and a tortuous flow path though the screen fibers dissipate energy, making these screens erosion resistant. These screens allow high production rates with minimal pressure drop due to their exceptional initial permeability of >700 darcies and a porosity that may range from about 85 percent to about 95 percent. Typical permeabilities of reservoir sands are 0.1-5.0 darcies, while the permeability of screens known under the trade designation is several hundred darcies when no sealant precursor composition is fixed in some of the openings between fibers. The permeability is slightly higher when a sealant precursor composition is present, but not significantly different from the "bare" fiber embodiments. A broad pore-size distribution in the filter media relative to the particle-size distribution of the sand acts to stabilize sand, minimizing pressure drop and reducing screen-face skin. Three-dimensional, substantially triangular spaces formed by the stainless steel fibers create a large open area that allows fluids and gas to easily pass through the fibrous filter media of the screens known under the trade designation MeshRite™. These screens reliably control a wide range of particle sizes and reduce the dependence on accurate particle size analysis and screen sizing. Fibrous filter media useful in the invention may retain sand associated with medium- to fine-grained reservoirs (D50>80 microns) with a medium degree of reservoir nonuniformity (D40/D90<10 microns). Unlike traditional sand-control methods that rely on fixed pore sizes and bridging, fibrous filter media useful in the invention resist failure and plugging, even with extended use. In particular, in fibrous filter media used in wellbore screen tools known under the trade designation MeshRite™, particles of various sizes, initially mobilized with fluid production, enter the outer third of the mesh and become stabilized in the triangular pore spaces, while large flow paths remain unobstructed. The perforated base tubular may be wrapped with the fibrous filter media, although other methods of applying the filter media to the base tubular may be used. The fibers may be compressed to form angular pore spaces from 15 to 600 microns in a three-dimensional structure that maximizes the porosity and permeability within the filter element. A perforated outer jacket protects the filter element and provides significant additional structural strength.

Fibrous filter media known under the trade designation MeshRite™ may have any length, but are typically provided in a variety of lengths ranging from 10 ft (3 m) up to 30 ft (9 m) sections wrapped on range 1, 2, and 3 base tubular. Diameter of the tool may range from about ¾ to 9⅝ in. (19.0 to 244.5 mm). The fibrous filer media may have a variety of compressions in accordance with the type of reservoir they are to be used in. So-called standard compression (SC) media and high compression (HC) designs may be suitable for reservoir sands with a D50>120 microns and a D50>75 microns, respectively. When the fibrous filter media comprises metallic fibers, the metallic fiber metallurgy may vary, usually in accordance with the corrosive nature of the fluids the fibrous filter media is expected to encounter in the wellbore environment. Stainless steels, for example, but not limited to, 316 and 434, may be used, as well as specialty and exotic metals such as platinum, beryllium, titanium, Monel, Inconel, and the like. The base tubular and jacket tubular also may have a variety of lengths, inner and outer diameters, and metallurgies. A list of possible steel nonwovens, base tubulars, and jacket tubulars useful in the present invention known under the trade designation MeshRite™ is provided at Table 1.

Other steel fiber-based nonwovens useful in the invention include those described in U.S. Pat. No. 4,176,420, incorporated by reference herein. This patent describes a continuous narrow strip or ribbon of stainless steel which is wound successively and alternately in random directions relative to a surface of a support piece in a plurality of wraps. The stainless steel strip may be in the form of a ribbon having a helical configuration so as to provide continuous coils extending throughout its length, thereby adding to the sponge-like characteristic of the media, increasing its porosity. A sufficient number of wraps are used to build up a pad of sufficient thickness and thereby form a sponge-like mass of the stainless steel ribbon. In this embodiment, the ribbon is relatively thin, the thickness of the ribbon depending on the specific type of operations for which the pad is to be used. The ribbon is also relatively narrow, preferably within the range of 1/16 to 1/8 of an inch (0.16 to 0.32 cm), the width depending to a degree on the type of operation for which the pad is to be used. In accordance with the effect desired, the coils may be formed in a tight-fitting relationship or spaced-apart, forming either a curled or a semi-curled configuration respectively throughout the continuous length of the ribbon. Another embodiment of the strip or ribbon which may be used to form the pad is a flat ribbon of stainless steel which may have a width and thickness selected in accordance with the considerations which dictate its dimensions. Thus, the ribbon may be of the same dimensions as the ribbon of the first embodiment except that it is provided in a helical configuration to form coils as explained above.

Another type of fibrous filter medium usable in the invention comprises an open, lofty, three-dimensional nonwoven web comprising a plurality of thermoplastic organic fibers, and a binder which adheres the fibers at points of mutual contact. This category of lofty, nonwoven filter media may be made from crimped, staple, thermoplastic organic fibers such as polyamide and polyester fibers, although it is also known to use other fibers such as rayon. Although crimping is not necessary to the invention, crimped, staple fibers can be processed and entangled into nonwoven webs by conventional web-forming machines such as that sold under the tradename "Rando Webber" which is commercially available from the Curlator Corporation. Methods useful for making nonwoven webs suitable for use in the invention from crimped, staple, synthetic fibers are disclosed by Hoover, et al., in U.S. Pat. Nos. 2,958,593 and 3,537,121, which are incorporated herein by reference. Continuous crimped or uncrimped fibers may also be used.

The staple fibers may be stuffer-box crimped, helically crimped as described, for example, in U.S. Pat No. 4,893,439, or a combination of both, and the nonwoven webs useful in the invention may optionally contain up to about 50 weight percent melt-bondable fibers, more preferably from about 20 to about 30 weight percent, to help stabilize the nonwoven web and facilitate the application of the coating resin.

Melt-bondable fibers useful in the present invention can be made of polypropylene or other low-melting polymers such as polyesters as long as the temperature at which the melt-bondable fibers melt and thus adhere to the other fibers in the nonwoven web construction is lower than the temperature at which the staple fibers or melt-bondable fibers degrade in physical properties under wellbore conditions. Suitable and preferable melt-bondable fibers include those described in U.S. Pat. No. 5,082,720, mentioned above. Melt-bondable fibers suitable for use in this invention must be activatable at elevated temperatures below temperatures which would adversely affect the helically crimped fibers. Additionally, these fibers are preferably coprocessable with the helically crimped fibers to form a lofty, open unbonded nonwoven web using conventional web forming equipment. Typically, melt-bondable fibers have a concentric core and a sheath, have been stuffer box crimped with about 6 to about 12 crimps per 25 mm, and have a cut staple length of about 25 to about 100 mm. Composite fibers have a tenacity of about 2-3 g/denier. Alternatively, melt-bondable fibers may be of a side-by-side construction or of eccentric core and sheath construction.

Fibers useful in the invention may be helically crimped polyester staple fibers in combination with a low-melting polyester melt-bondable fiber. Helically crimped polyethylene terephthalate (PET) fibers may be used.

U.S. Pat. No. 3,595,738, incorporated herein by reference, discloses methods for the manufacture of helically crimped bicomponent polyester fibers suitable for use in this invention. The fibers produced by the method of that patent have a reversing helical crimp. U.S. Pat. Nos. 3,868,749, 3,619,874, and 2,931,089, all of which are incorporated herein by reference, disclose various methods of edge crimping synthetic organic fibers to produce helically crimped fibers.

Helically crimped fibers may have from about 1 to about 15 full cycle crimps per 25 mm fiber length, while stuffer box crimped fibers may have about 3 to about 15 full cycle crimps per 25 mm fiber length. As taught in the '439 patent, when helically crimped fibers are used in conjunction with stuffer box crimped fibers, preferably the helically crimped fibers have fewer crimps per specified length than the stuffer box fibers.

Crimp index, a measure of fiber elasticity, may ranges from about 35 to about 70 percent for helically crimped fibers, which is about the same as stuffer box crimped fibers. Crimp index can be determined by measuring fiber length with appropriate "high load" attached, then subtracting fiber length with appropriate "low load" attached, and then dividing the result value by the high load fiber length and multiplying that value by 100. (The values of the appropriate "high load" and "low load" depend on the fiber denier. For fibers of the invention having 50 100 denier, low load is about 0.1-0.2 grams, high load is about 5-10 grams.) The crimp index can also be determined after exposing the test fibers to an elevated temperature, e.g., 135 C to 175 C for 5 to 15 minutes, and this value compared with the index before heat exposure. Crimp index measured after the fiber is exposed for 5 to 15 minutes to an elevate temperature, e.g., 135 C to 175 C, should not significantly change from that measured before the heat exposure. The load can be applied either horizontally or vertically.

The length of the organic fibers employed is dependent on upon the limitations of the processing equipment upon which the nonwoven open web is formed. However, depending on types of equipment, fibers of different lengths, or combinations thereof, very likely can be utilized in forming the lofty open webs of the desired ultimate characteristics specified herein. Fiber lengths suitable for helically crimped fibers preferably range from about 60 mm to about 150 mm, whereas suitable fiber lengths for stuffer box fibers range from about 25 to about 70 mm.

Fiber size suitable for producing lofty, open, low density nonwoven products from organic fibers is an important consideration. The thickness (denier) of organic fibers used in nonwoven articles may range broadly from about 6 to about 400, and may range from about 15 to about 200 denier, and may range from about 50 to about 100 denier. Finer deniers than about 15 may result in increased frictional drag. Fiber deniers larger than about 200 reduce drag.

Nonwoven articles useful in the invention comprising organic fibers, when formed for use as fibrous filter media for use in tools of the invention, may have a non-compressed thickness of at least about 0.5 cm, and may range from about 2 cm to about 10 cm. As mentioned above, the thickness is dependent upon the fiber denier chosen for the particular application. If the fiber denier is too fine, the nonwoven articles may be less lofty and open, and thus thinner, resulting in the article tending to be more easily loaded with particles.

Binders suitable for use in organic fiber nonwovens useful in the invention may comprise any thermoplastic or thermostat resin suitable for manufacture of nonwoven articles, but it will be clear to those skilled in the art of such manufacture that the resin in its final, cured state must be compatible (or capable of being rendered compatible) with the fibers of choice.

Another consideration is that the cured resin should be soft enough to allow the nonwoven articles to be somewhat flexible during use so as to allow the pad to conform to irregularities in the tubulars. However, the cured resin should not be so soft as to cause undue frictional drag between the nonwoven articles of the invention and the tubulars. Suitable resins will not readily undergo unwanted reactions, will be stable over a wide pH and humidity ranges, and will resist moderate oxidation and reduction. The cured resins should be stable at higher temperatures and have a relatively long shelf life.

The resins of the binders suitable for use in organic-fiber containing nonwoven articles useful in the invention, and which may also be used to adhere sealant precursor compositions to organic and/or inorganic fibers, such as in steel wool media, may comprise a wide variety of resins, including synthetic polymers such as styrene-butadiene (SBR) copolymers, carboxylated-SBR copolymers, melamine resins, phenol-aldehyde resins, polyesters, polyamides, polyureas, polyvinylidene chloride, polyvinyl chloride, acrylic acid-methylmethacrylate copolymers, acetal copolymers, polyurethanes, and mixtures and cross-linked versions thereof. In certain embodiments, the sealant precursor composition may adhere itself to the fibers and require no additional binder.

One preferred group of resins useful in the present invention, particularly if a substantial number of the fibers of the nonwoven web are polyester, are terpolymeric latex resins formed by linear or branched copolymerization of a mixture of a non-functionalized monoethylenically unsaturated co-monomer, a functionalized monoethylenically unsaturated co-monomer, and a non-functionalized diethylenically unsaturated co-monomer. ("Functionalized", as used herein, means a monomer having a reactive moiety such as —OH, $NH_2$, COOH, and the like, wherein "non-functionalized" means a monomer lacking such a reactive moiety.)

Useful terpolymer latex resins, used when the fibers of the nonwoven web are substantially polyester, may be formed by random or block terpolymerization of styrene, butadiene, and a functionalized monoethylenically unsaturated monomer selected from monomers having the general formula $R^1R^2C{=}CR^3COOH$ and anhydrides thereof, wherein $R^1$ and $R^2$ are independently selected from H and $CH_3$, and $R^3$ is selected from H, $CH_3$ and COOH. In commercially available resins of this type, the amount of functionalized monoethylenically unsaturated monomer is typically proprietary, but is believed to be about 1 to about 10 mole percent of the total monomer. The mole percent of styrene may range from about 50 percent to about 80 percent as mole percentage of styrene and butadiene.

The terpolymer latex resin may be that sold under the trade designation "AMSCO RES 5900", from Unocal. This aqueous latex resin is a terpolymer of styrene/butadiene/functionalized monoethylenically unsaturated monomer having styrene/butadiene mole ratio of 65/35, 1-10 mole percent of functionalized monoethylenically unsaturated monomer, solids weight percent of 50, pH of 9.0, anionic particle charge, particle size of 0.2 micrometer, and glass transition temperature of −5 C. Higher butadiene mole ratios produce a softer resin, but at the cost of greater drag. Typical and preferred coatable binder precursor solutions containing this latex resin which are useful in forming cured binders are presented in Table A (wet parts by weight).

The above described terpolymers may be used uncross-linked, but they are preferably cross-linked by the reaction of the reactive COOH moiety with a polyfunctionalized monomer, such as a phenolic or melamine resin, as indicated in Table A.

Cross-linking resins, as mentioned in Table A, below, may be used to improve the water and solvent resistance of the nonwoven articles, and to increase their firmness. Melamine-formaldehyde resins, such as the fully methylated melamine-formaldehyde resins having low free methylol content sold under the trade designations "Cymel 301", 1133, and 1168, "Cymel 303" and "Aerotex M-3" (all currently available from American Cyanamid Company), and the like, are suitable. The former provides slightly higher tensile strength while the latter enhances stiffness and resilience of the nonwoven. Phenolic resins have also been used as cross-linking resins, such as those sold under the trade designations "433" (Monsanto) and "R-7" (Carborundum), and the like.

Latex resins useful in the present invention, if cross-linked, may have greater than 10% cross-linking, usually having in the range from about 15% to 80% cross-linking, more usually having in the range from about 25% to 60% cross-linking, and typically being in the range from about 45% to 55% cross-linking. The cross-linked latex resin particles may act as organic fillers, helping to smooth the coating of the fibers of the nonwoven webs with the linear or branched copolymers. The calculated or theoretical percentage of cross-linking is defined as the weight of polyfunctionalized monomer (or monomers) divided by the total weight of monomers.

TABLE A

Preferred Binder Precursor Solutions

| Ingredient | Broad wt % Range | Preferred wt % Range |
|---|---|---|
| SBR latex (50% solids) | 20-40 | 25-35 |
| water | 2-10 | 2-6 |
| melamine-formaldehyde/ crosslinking resin | 1-10 | 1-5 |
| catalyst (40% sol. of diammonium phosphate) | 0.1-0.5 | 0.1-0.3 |
| antifoam agent | 0.01-0.05 | 0.01-0.03 |
| surfactant | 0.1-1.0 | 0.1-0.5 |

Non-functionalized monoethylenically unsaturated monomers generally suitable for preparing linear, branched, and cross-linked latex resins useful herein include, styrene, ethylvinylbenzene, and vinyltoluene.

Diethylenically unsaturated monomers useful in the invention include isopropene, butadiene and chloroprene, with butadiene being particularly preferred.

If the nonwoven filter media comprise a substantial amount of polyamide (e.g., nylon 6,6) fibers, other resins may be used as the resin component of the binder. Examples of suitable binders for use when the fibers comprise polyamides include: phenolic resins, aminoplast resins, urethane resins, urea-aldehyde resins, isocyanurate resins, and mixtures thereof. One preferred resin is a thermally curable resole phenolic resin, such as described in Kirk-Othmer, Encyclopedia of Chemical Technology, 3rd Ed., John Wiley & Sons, 1981, N.Y., Vol. 17, p. 384-399, incorporated by reference herein.

Examples of commercially available phenolic resins include those known by the trade names "Varcum" and "Durez" (from Occidental Chemicals Corp., N. Tonawanda, N.Y.), and "Arofene" (from Ashland Chemical Co.). The resole phenolic resin of choice has about 1.7:1 formaldehyde to phenol weight ratio, 76 weight percent solids.

Methods of making organic fiber-based lofty, three-dimensional webs is known in the art and need not be explained here in detail. In one method, a coatable binder precursor solution, comprising uncured resin, and other ingredients, such as thickeners, depending on the coating procedure, is applied to a nonwoven web using two-roll coating. Then, during further processing, the binder precursor is cured or polymerized to form a cured binder. Other coating methods may of course be employed as are known in the art, such as spray coating, and the like. Binder precursor solutions and cured binders suitable for use in the invention may contain appropriate curing agents, non-abrasive fillers, pigments, and other materials which are desired to alter the final properties of the nonwoven articles. In particular, it may be desired to color the nonwoven articles to characterize the article (for example white being the least porous, darker colors indicating more porous). Thus, the resins, binder precursor solutions, and binders useful in the invention may be compatible or capable of being rendered compatible with pigments.

U.S. Pat. No. 6,450,260, incorporated herein by reference, describes many useful compositions that may be used as sealant precursor compositions and, when triggered by a chemical mechanism, triggering compositions. While the compositions described herein are described as comprising certain materials, it should be understood that the sealant precursor compositions and triggering compositions (when used) may optionally comprise two or more chemically different such materials. For example, a composition could comprise a mixture of two or more gel components, crosslinking agents, or other additives, provided that the compounds chosen for the mixture are compatible with the intended use of the composition as taught herein. The '260 patent describes consolidating fluids based on aqueous solutions. The solution can comprise buffers, pH control agents, and various other additives added to promote the stability or the functionality of the fluid. Sealant precursor compositions useful in the invention may comprise a component that gels (gellable component) upon being triggered. The gel may be flexible or substantially inflexible. A "gellable component," as the term is used herein, is a compound or compounds that, under at least some downhole conditions, can form a flexible gel. If the gellable component is a polymer, the gel may be formed by cross-linking of the polymer, preferably in a three-dimensional network. Cross-linking may occur by contacting the gellable component with a triggering composition, by heat, light, or some other mechanism or combination of mechanisms. If the gel component is a monomer, the is formed by polymerization, preferably generating a three-dimensional polymer network.

As used herein, a "flexible gel" is a gel that is essentially non-rigid after consolidating the formation. Non-rigidity of a gel can be determined by any one or more techniques described in the '260 patent. A non-rigid gel is one that will substantially return to its starting condition after compression with a linear strain of at least about 10%, preferably at least about 25%, and more preferably greater than about 50%. (Minute permanent deformation may be seen at a sufficiently small scale). The unconfined compressive strength (UCS) of loose sand (40-60 U.S. mesh) consolidated with a flexible gel, as measured according to standard protocols, is typically about 2 psi to about 400 psi, preferably about 2 psi to about 50 psi. (It should be noted a flexible gel by itself typically has a UCS less than about 5 psi). The storage modulus G' of a flexible gel, as measured according to standard protocols given in U.S. Pat. No. 6,011,075, is typically about 150 dynes/$cm^2$ to about 500,000 dynes/$cm^2$, preferably from about 1000 dynes/$cm^2$ to about 200,000 dynes/$cm^2$, more preferably from about 10,000 dynes/$cm^2$ to about 150,000 dynes/$cm^2$.

Another feature of the flexible gels described in the '260 patent is that it significantly reduces the permeability of the formation or gravel pack, by which is meant reducing the permeability by at least about 90%, or at least about 95%, or at least about 99%. This also describes the reduction in permeability of the fibrous filer media useful herein.

Gel components capable of forming a gel (including flexible gels) include the following exemplary water-soluble polymers, copolymers, or terpolymers: polyvinyl polymers (such as polyvinyl alcohol or polyvinyl acetate), polyacrylamides, acrylamide copolymers and terpolymers, acrylic acid-methacrylamide copolymers, partially hydrolyzed polyacrylamides, polymethacrylamides, partially hydrolyzed polymethacrylamides, cellulose ethers, polysaccharides, heteropolysaccharides, lignosulfonates, polyalkyleneoxides, carboxycelluloses, carboxyalkylhydroxyethyl celluloses, hydroxyethylcellulose, galactomannans, substituted galactomannans, the ammonium salts or alkali metal salts of the foregoing, and alkaline earth salts of lignosulfonates, among others.

Exemplary water-soluble polymerizable monomers that can be used as a gel component include acrylic acid, acrylamide, methacrylic acid, methacrylamide, hydroxyethylacrylate, maleic acid, diallyldimethyl ammonium chloride, methylene bis-acrylamide, urea, vinyl acetic acid, styrene sulfonic acid, salts thereof, or mixtures thereof. Neither list is intended to be exhaustive.

The concentration of a polymeric gel component in the sealant precursor composition may range from about 1 wt % to about 10 wt % gel component, and may range from about 4 wt % to about 8 wt % gel component. The concentration of a monomer gel component may range from about 2 wt % to about 60 wt %, and may range from about 5 wt % to about 45 wt %.

The '260 describes a gel-forming agent, and this may coincide with the triggering component used in the present invention. If the sealant precursor composition is a polymer, the triggering component may be a crosslinking agent, i.e. an agent capable of crosslinking polymer molecules to form a three-dimensional network. Exemplary organic crosslinking agents include, but are not limited to, aldehydes, dialdehydes, phenols, substituted phenols, and ethers. Exemplary inorganic crosslinking agents include, but are not limited to, polyvalent metals, chelated polyvalent metals, and compounds capable of yielding polyvalent metals.

If the sealant precursor composition is provided as a monomer, the triggering component may be able to crosslink the monomer or catalyze the polymerization of the monomer to form a three-dimensional network.

The concentration of the triggering component in the triggering composition may range from about 0.001 wt % to about 5 wt %, and may range from about 0.005 wt % to about 2 wt %.

Optionally, if the sealant precursor composition comprises a monomer and the triggering component is chosen to crosslink the monomer, the triggering composition may further comprise a water-soluble initiator to start the crosslinking reaction. Exemplary initiators include oxidizers, such as ammonium persulfate or azo compounds, such as 2,2'-azobis (2-arnidinopropane)dihydrochloride, among others. The concentration of the initiator may range from about 0.0001 wt % to about 5 wt %. Optionally, agents to accelerate or delay initiation, such as potassium ferricyanide, may be added as well.

If the triggering mechanism is chemical, the triggering composition may not form a gel until after its injection into the formation. Before that time, it is desirably a flowable solution that may be readily pumped or otherwise handled. In order to prevent gelation until after the triggering composition is injected into the formation, the triggering composition may be formed shortly before injection into the formation. The triggering component may be the last ingredient added to the nascent triggering composition during the latter's formation. Since the sealant precursor composition is located in the fibrous filter element downhole and the triggering component is at the surface until injected, there is physical separation already; however, a gelation inhibitor that readily degrades upon exposure to downhole conditions may be a component of the triggering composition, or a reaction that is temperature initiated may be employed. Whichever approach is used, it is desirable that after injection of the triggering composition, gelation is allowed to readily occur, such as by stripping any emulsifying agent against the formation face or degradation of a gelation inhibitor under downhole temperature. If premature gelation was inhibited by preparing the triggering composition shortly before use, then gelation will typically readily occur after injection.

The triggering composition (if used) and sealant precursor composition may further comprise stabilizing agents, surfactants, diverting agents, or other additives. Stabilizing agents can be added to slow the degradation of the gel after its formation downhole. Typical stabilizing agents include buffering agents, especially agents capable of buffering at pH of about 8.0 or greater (e.g. water-soluble bicarbonate salts, carbonate salts, phosphate salts, or mixtures thereof, among others); and chelating agents (e.g. ethylenediaminetetraacetic acid (EDTA), nitrilotriacetic acid (NTA), or diethylenetriaminepentaacetic acid (DTPA), hydroxyethylethylenediaminetriacetic acid (HEDTA), or hydroxyethyliminodiacetic acid (HEIDA), among others). Buffering agents may be added to the triggering composition to at least about 0.05 wt %, or at least about 0.75 wt %. Chelating agents may be added to a triggering composition to at least about 0.75 mole per mole of metal ions expected to be encountered in the downhole environment, or at least about 0.9 mole per mole of metal ions.

Surfactants may be added to promote dispersion or emulsification of components of the triggering composition, or to provide foaming of the gel upon its formation downhole. Usable surfactants include, but are not limited to, alkyl polyethylene oxide sulfates, alkyl alkylolamine sulfates, modified ether alcohol sulfate sodium salts, or sodium lauryl sulfate, among others. A surfactant may be added to the triggering composition in an amount ranging from about 0.01 wt % to about 10 wt %, or from about 0.1 wt % to about 2 wt %. Surfactant may be added to a triggering composition shortly before injection.

After the triggering composition is prepared, it may be injected into a formation to initiate water shut off of at least a portion of the formation. Techniques for injection of fluids are well known in the art. Typically, a triggering composition would be injected through the wellbore, through coiled tubing or other tubular, into the formation at a pressure less than the fracturing pressure of the formation. Formations for which water shut off may be desirable include sand, sandstone, chalk, and limestone, among others. Typically, a triggering composition would be injected below the formation fracturing pressure.

The volume of triggering composition to be injected, if used at all, into the formation is a function of the number and size of wellbore tools comprising open, lofty fibrous filter media. The volume may be readily determined by one of ordinary skill in the art. Packers or similar devices can be used to control flow of the triggering composition into the formation for which water shut off is desired. The minimum and maximum injection rates that can be used are a function of the downhole gelation rate; the maximum pressure that will not lead to fracturing of the formation, if relevant; and limitations of equipment. Preferably, the gelation rate is sufficiently slow to allow complete injection of the desired volume into the formation, but is sufficiently rapid to allow a quick gelation after injection and thus minimize the time spent to perform the water shut off method.

After the triggering mechanism is delivered to the site or sites in the wellbore it is needed, gelation occurs, whereby the gel component is cross-linked or polymerized, as appropriate given the sealant precursor composition. In either case, a gel may be formed in at least some open regions of the lofty, open fibrous filter medium near a surface of the fibrous filter medium.

Other sealant precursor composition and/or triggering composition chemistries may be employed, as long as at least one of the components can adhere or otherwise remain trapped in an inert state by the fibrous filter media during normal operations, but be triggered by another component to form a seal as explained herein. Such other chemistries include compositions known under the trade designation SANDLOCK™ (Schlumberger), which comprise a resin, and optionally a curing agent, a catalyst, and an oil wetting agent, as more thoroughly described in U.S. Pat. No. 6,632,778. When injected into the formation, the resin (acted upon by the curing agent and catalyst, if present) hardens, causing a rigid seal. These systems were designed to maintain sufficient permeability of the formation to allow production, but in a water shut off application, a good seal is desired at the wellbore screen tool, as explained herein. Other useful chemistries and methods for their use are reported in U.S. Pat. Nos. 5,806,593; 5,199,492; 4,669,543; 4,427,069; and 4,291,766. U.S. Pat. No. 5,712,314 discusses the use of a flexible furan resin system for water control. U.S. Pat. Nos. 5,246,073; 5,335,733; 5,486,312; and 5,617,920, assigned to Unocal, describe a fluid comprising a polyvinyl polymer, a polymethacrylamide, a cellulose ether, a polysaccharide, a lignosulfonate, an ammonium salt or alkali metal salt of the foregoing, or an alkaline earth salt of a lignosulfonate; and a crosslinking agent, such as an aldehyde, a dialdehyde, a phenol, a substituted phenol, an ether, a polyvalent metal, a chelated polyvalent metal, or a compound capable of yielding a polyvalent metal. One version of such a fluid is commercially available under the trade name "OrganoSEAL-R." These references teach the fluid can be used to seal a wellbore to prevent contamination by water from a water-containing formation penetrated by the wellbore. U.S. Pat. Nos. 4,683,949 and 5,947,644, assigned to Marathon Oil Co., describe a fluid comprising polyacrylamide and a chromium III/carboxylate complex crosslinking agent. The fluid is commercially available under the trade name "MARASEAL." These references also teach the fluid can be used to seal a wellbore to prevent contamination by water from a water-containing formation penetrated by the wellbore. Zeltmann et al., U.S. Pat. No. 6,047,773, assigned to Halliburton Energy Services, Inc., reports the use of viscous fluids, such as fluids comprising hydroxyethylcellulose, guar, or acrylic, to occupy a wellbore and provide a barrier to entry of stimulation fluids into a formation. The viscous barrier fluid itself is taught to not penetrate the formation. U.S. Pat. No. 6,011,075 discloses flexible gel compositions having increased storage modulus G' while maintaining flexibility, the compositions or fluids comprising an aqueous liquid, such as water, an effective amount of a water soluble crosslinkable polymeric gel forming material, and a crosslinking agent; and an effective or gel strengthening amount of an inert colloidal particulate material. The crosslinkable polymeric gel forming composition is preferably selected from water soluble crosslinkable polymers and polymerizable monomers capable of forming a water soluble crosslinkable polymer, and mixtures thereof. As used therein, the term "colloidal" refers not only to the size of the particles but to the capability of the particulate material in forming at least substantially stable dispersions in an aqueous liquid, while the term "inert" indicates that the particulate material retains its identity to at least a substantial extent in the aqueous liquid. The compositions may be foamed. All of the patents mentioned in this paragraph are incorporated by reference herein, once again with the proviso that at least one of the components can adhere or otherwise remain trapped in an inert state by the fibrous filter media during well production and workover operations, but be triggered to form a water shut off seal when desired, as explained herein.

Certain methods of the invention utilize a communication line. The communication line may have one or more than one function. In certain embodiments the communication line may only communicate information, either one way or two-way between the wellbore screen tool location and the surface. In other embodiments the communication line may include one or more sensing devices at or near the distal end of the communication line. Systems of the invention may include a pressurized housing for a reel, a pumping system for conveying the communication line down the wellbore to the tool using one or more well treatment fluids, such as one or more triggering fluids, well stimulation or other fluids, and optionally, depending on the embodiment, means for re-spooling the communication line, means for guiding the communication line down and back out of the wellbore, and a surface data acquisition and/or monitoring system, as described in pending U.S. patent application Ser. No. 11/278,512 filed Apr. 3, 2006, incorporated herein by reference.

The optical fiber may typically be transported to the wellhead on a small drum. It may be introduced into the flow of the fluid by passing the fiber through a stuffing box such as disclosed in U.S. Pat. No. 3,831,676, in which case the reel is not subjected to the wellbore pressure. Alternatively, the fiber may be spooled onto a reel which is enclosed in a housing attached to the wellhead and thus subjected to the wellbore pressure, as described in pending U.S. patent application Ser. No. 11/278,512 filed Apr. 3, 2006, previously incorporated herein by reference. The optical fiber may optionally be encased in a small amount of cladding for protection from abrasion and corrosion. The cladding may also help minimize long term darkening of the fiber caused by exposure to hydrogen ions. Rather than bringing a secondary coiled tubing unit to the location, instead the fiber is passed into the flow-path of the pumped treatment and/or stimulation fluids. The flowing fluid provides sufficient drag on the fiber that it may be conveyed the full length of the wellbore while the fluid is being bull-headed. Miniature sensors may be added to the end of the fiber to provide downhole pressure, flow, or other information. Alternatively, the fiber itself may be modified by the addition of gratings along its length. Surface interrogation of optical fiber gratings may be performed with a laser at the surface as disclosed, for example, in U.S. Pat. No. 5,841,131, incorporated herein by reference.

By "pumping system" we mean a surface apparatus of pumps, which may include an electrical or hydraulic power unit, commonly known as a powerpack. In the case of a multiplicity of pumps, the pumps may be fluidly connected together in series or parallel, and the energy conveying a triggering composition or communication line, or both, may come from one pump or a multiplicity. The pumping system may also include mixing devices to combine different fluids or blend solids into the fluid, and the invention contemplates using downhole and surface data to change the parameters of the fluid being pumped, as well as controlling on-the-fly mixing.

By the phrase "surface acquisition system" is meant one or more computers at the well site, but also allows for the possibility of a networked series of computers, and a networked series of surface sensors. The computers and sensors may exchange information via a wireless network. Some of the computers do not need to be at the well site but may be communicating via a communication system such as that known under the trade designation InterACT™ or equivalent communication system. In certain embodiments the communication line may terminate at the wellhead at a wireless transmitter, and the downhole data may be transmitted wirelessly. The surface acquisition system may have a mechanism to merge the downhole data with the surface data and then display them on a user's console.

In exemplary embodiments of the invention, advisor software programs may run on the acquisition system that would make recommendations to change the parameters of the operation based upon the downhole data, or upon a combination of the downhole data and the surface data. Such advisor programs may also be run on a remote computer. Indeed, the remote computer may be receiving data from a number of wells simultaneously.

The surface acquisition system may also include apparatus allowing communication to the downhole sensors. For example, in embodiments wherein the communication line includes an optical fiber, laser devices, such as diode lasers, may be used to interrogate the state of downhole optical components. Optionally, the laser devices may transmit a small amount of power to any downhole component on the end of the communication line. The surface acquisition system should be able to control the surface communication apparatus and the user's console would typically display status of those apparatus.

Communication lines useful in the invention may have a length much greater than their diameter, or effective diameter (defined as the average of the largest and smallest dimensions in any cross section). Communication lines may have any cross section including, but not limited to, round, rectangular, triangular, any conical section such as oval, lobed, and the like. The communication line diameter may or may not be uniform over the length of the communication line. The term communication line includes bundles of individual fibers, for example, bundles of optical fibers, bundles of metallic wires, and bundles comprising both metallic wires and optical fibers. Other fibers may be present, such as strength-providing fibers, either in a core or distributed through the cross section, such as polymeric fibers. Aramid fibers are well known for their strength, one aramid fiber-based material being known under the trade designation "Kevlar". In certain embodiments the diameter or effective diameter of the communication line may be 0.125 inch (0.318 cm) or less. In one embodiment, a communication line would include an optical fiber, or a bundle of multiple optical fibers to allow for possible damage to one fiber.

In an alternative embodiment, the communication line may comprise a single optical fiber having a fluoropolymer or other engineered polymeric coating, such as a Parylene coating. The advantage of such a system is the cost is low enough to be disposable after each job. One disadvantage is that it needs to be able to survive being conveyed into the well, and survive the subsequent fluid stages, which may include proppant stages. In these embodiments, a long blast tube or joint comprising a very hard material, or a material coated with known surface hardeners such as carbides and nitrides may be used. The communication line would be fed through this blast tube or joint. The length of blast joint may be chosen so that the fluid passing through the distal end of the joint would be laminar. This length may be dozens of feet or meters, so the blast joint may be deployed into the wellbore itself. In embodiments where the communication line is a single fiber, the sensing apparatus may need to be very small. In these embodiments, nano-machined apparatus that may be attached to the end of the fiber without significantly increasing the diameter of the fiber may be used. Similar devices are marketed for downhole pressure measurement by Sensa, Southampton, United Kingdom. A small sheath may be added to the lowest end of the fiber and cover the sensing portion so that any changes in outer diameter are very gradual.

In one embodiment of the invention the sensing device is the communication line itself. For example, the communication line may include an optical fiber, and the data transmitted may be distributed temperature. Accessing distributed temperature is known in the art, except for the teachings herein, and has been disclosed, for example, by U.S. Pub. Pat. App. No. US20040129418, "Use of distributed temperatures during wellbore treatments" by Jee, et al., incorporated by reference herein. Alternatively, an optical fiber itself may be modified by the addition of doping or gratings along its length. Surface interrogation of these gratings may be done with a laser at the surface as disclosed, for example, in U.S. Pat. No. 5,841,131, incorporated by reference herein.

Referring now to the drawing figures, FIG. 1 is a cross section of a wellbore 10 showing a typical completion system using wire-wrap screens of the prior art. Wellbore 10 has penetrated a subterranean zone 12 that includes a productive formation 14 that may at some point produce an unacceptable amount of water. Wellbore 10 has a casing 16 in this embodiment that has been cemented in place, but this is not necessary to the invention. The casing 16 has a plurality of perforations 18 which allow fluid communication between the wellbore 10 and the productive formation 14. A well tool 20 is positioned within the casing 16 in a position adjacent to the productive formation 14 in order to install a tubing-conveyed patch for water shut off. The well tool 20 comprises a tubular member 22 attached to a packer 24, which may be an annular gel packer, a cross-over 26, two wire-wrap sand screen elements 28 and a lower packer 30. Blank sections 32 of pipe are typically used to properly space the relative positions of each of the components. An annulus area 34 is created between each of the components and the wellbore casing 16. The combination of the well tool 20 and the tubular string extending from the well tool to the surface can be referred to as the production string.

In a typical water shut off operation when multiple wire-wrap screens 28 are present, the wire-wrap screens are typically substantially plugged with fines, and water enters the production string through joints in the production string. Wire-wrap sand screens need to be have openings small enough to restrict particulate flow, often having gaps in the 60-120 mesh range, but other sizes may be used. The packer elements 24, 30 are set to ensure a seal between the tubular member 22 and the casing 16. A series of tubular patches may be installed via tubular member 22 at joints between the wire-wrap screens 28 and blank sections 32. Gels or other chemicals may also be injected to prevent water from being produced, however, placing the gel or other sealant composition is not specific in location and maybe wasted, possibly damaging the well, and/or reducing production of hydrocarbons when water is not being produced. Some water may also be produced by way of the sand screen elements 28 and enter the tubular member 22, and flows up through the tubular member 22 until the cross-over 26 places it in the annulus area 36 above the production packer 24 where it can leave the wellbore 10 at the surface.

Figure 2:
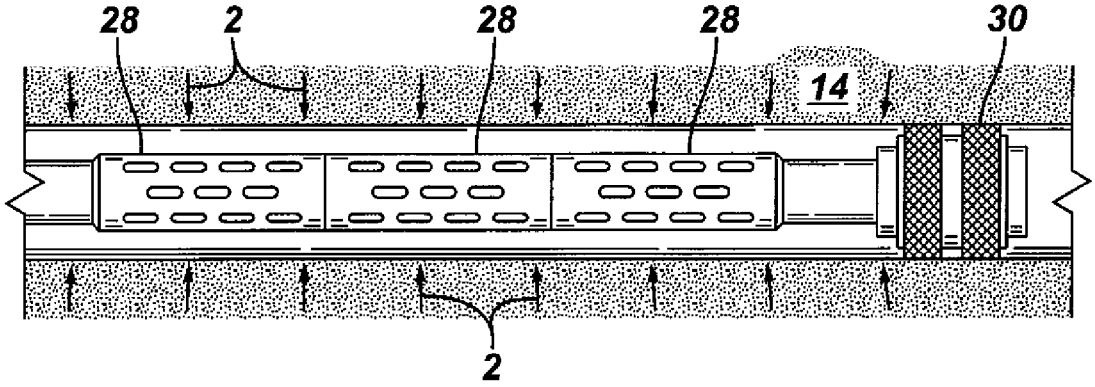
FIG. 2 (Prior Art)
FIG. 2 is a schematic partial cross-sectional view of a prior art system and method.

FIG. 2 is a schematic partial cross-sectional view of a prior art system and method, illustrating an open-hole water shut off arrangement. Arrows 2 show how water would enter each wire-wrap screen 28 in a prior art arrangement consisting of three wire-wrap screens 28. Blank casing pipes are used between wire wrap screens 28, but are not shown in FIG. 2. One EZIP annular packers 30 is illustrated. The typical length of completion segments between two open-hole EZIP annular packers is about 100 m, with two or more 10 m wire wrap screens 28 distributed amongst blank casing pipes along this 100 m. Water shut off techniques in these systems span the range of mechanical and chemical treatments. One mechanical water shut off treatment typically used is a through-tubing casing patch, while chemical treatments include polymeric gels, many of which are crosslinked and may be delayed action.

Figure 3:
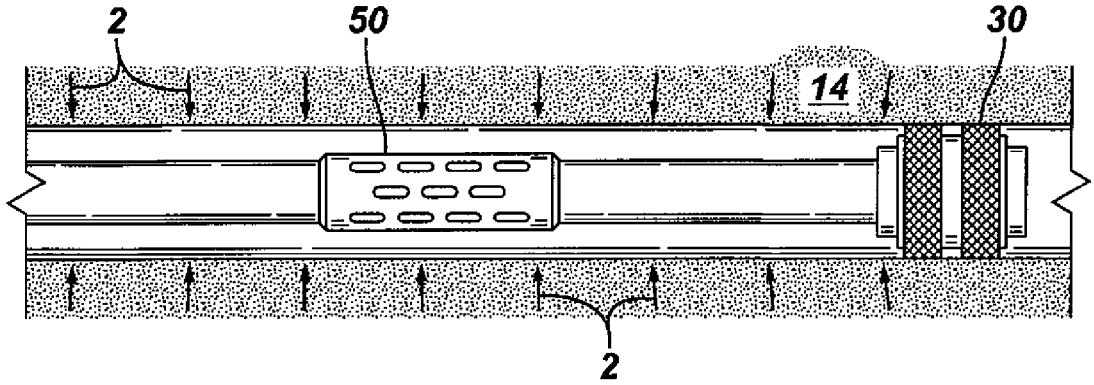
FIG. 3 is schematic partial cross-sectional view of an embodiment of the invention.

FIG. 3 is schematic partial cross-sectional view of an embodiment of the invention, illustrating how a single wellbore screen tool 50 may replace 2 or more wire wrap screens 28 of FIG. 2. Since the wellbore screen tools described herein do not plug with fines, they can handle much more production fluids per unit, and when the percentage of water becomes unacceptable, or for some other reason, the operator decides to shut off production, the sealant precursor composition may be activated to seal the wellbore screen tool 50.

Figure 4:
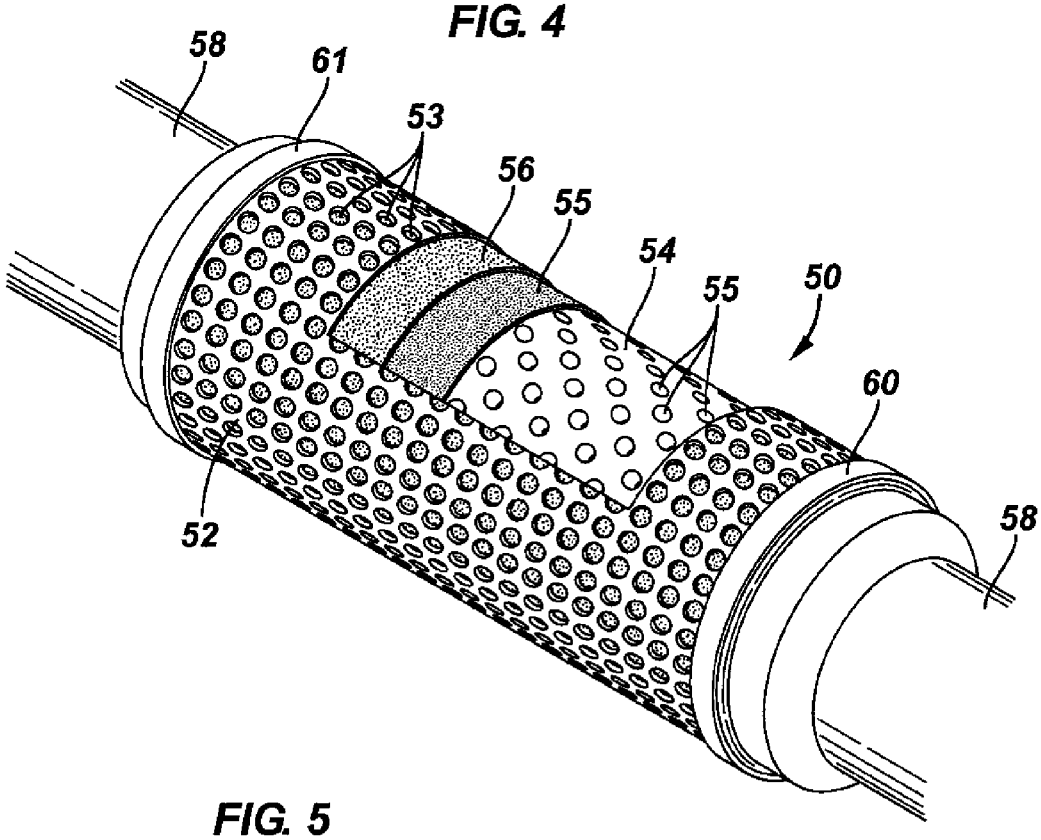
FIG. 4 is a perspective view, with some portions broken away, of an apparatus useful in the invention.

FIG. 4 is a perspective view, with some portions broken away, of the wellbore screen 50 of FIG. 3. A jacket tubular 52 is illustrated having a plurality of openings 53. A base tubular 54 also having a plurality of openings 55 is illustrated, upon which a first 55 and a second 56 wrap of a fibrous filter material is wrapped. A pair of boss rings 60 and 61 are typically provided, and welded to non-perforated spacer tubular 58. Spacer tubular may be the same as base tubular 54 but with out the openings. Jacket tubular 52, also referred to as a shroud, and fibrous filter material 55, 56 may define a space therebetween. In some embodiments, the wellbore screen tool 50 may comprise one or more shunt tubes (not shown, also known as alternate paths) positioned in the space between the fibrous filter material 55, 56 and jacket tubular 52. The shunt tubes may be attached to base tubular 54 by an attachment ring. The methods and devices of attaching shunt tubes to base tubular 54 may be replaced by any one of numerous equivalent alternatives. The shunt tubes may be used for any of a variety of operations, for example to transport gravel laden slurry during a gravel pack operation, thus reducing the likelihood of gravel bridging and providing improved gravel coverage across the zone to be gravel packed. Shunt tubes may also be used to distribute treating fluids more evenly throughout the producing zone, such as during an acid stimulation treatment. The jacket tubular or shroud 52 may comprise at least one channel therein (not shown), or indented area in the shroud 52 that extends along its length linearly, helically, or in other traversing paths, an din some embodiments the channel may have a depth sufficient to accommodate a control line therein.

Figure 5:
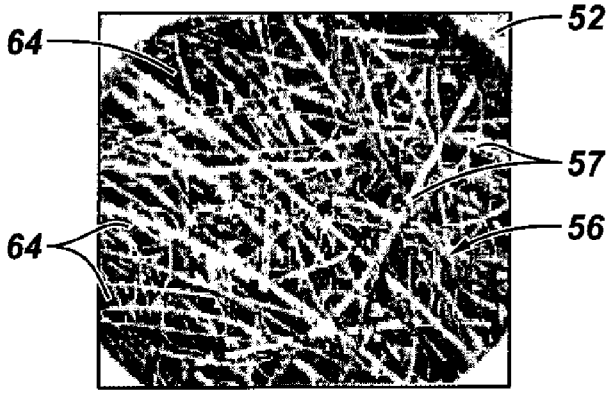
FIG. 5 is a photograph of fibrous filter media useful in the invention.
Figure 6A:
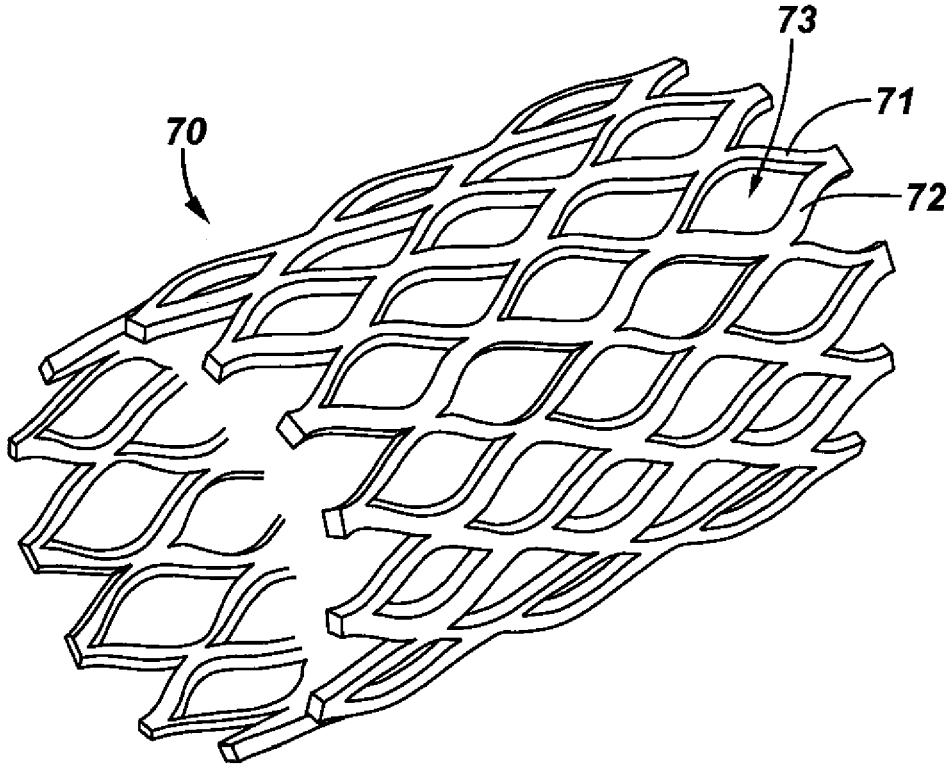
FIGS. 6A and 6B are schematic illustrations of two different fibrous filter media useful in the invention.
Figure 6B:
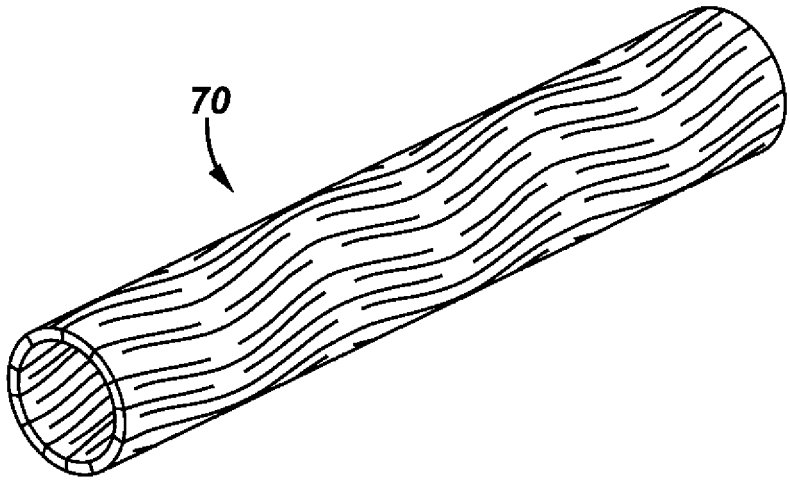

FIG. 5 is a photograph of, and FIGS. 6A-B are schematic illustrations of two different fibrous filter media useful in the invention. FIG. 5 illustrates photographically an embodiment of a stainless steel mesh filter material known under the trade designation MeshRite™, discussed in more detail previously herein, installed in a wellbore screen tool, showing one layer 56 having a plurality of stainless steel fibers 57 forming a plurality of generally triangular spaces therebetween. Although not illustrated in this embodiment, a sealant precursor composition may be applied to some or all of the fibers 57 and/or in spaces 64. As may be seen, even if a coating of sealant precursor composition is coated on fiber 57 and/or placed in some of the spaces 64, the porosity of the material will not be significantly affected.

FIGS. 6A and 6B illustrate expanded and collapsed versions, respectively, of another fibrous filter media embodiment 70 useful in the invention employing a bistable material. Bistable structures, sometimes referred to as toggle devices, have been used in industry for such devices as flexible discs, over center clamps, hold-down devices and quick release systems for tension cables (such as in sailboat rigging backstays). An expandable bore bistable tubular, such as casing, a tube, a patch, or pipe, can be constructed with a series of circumferential bistable connected cells 73 as shown in FIGS. 6A and 6B, where each thin strut 71 is connected to a thick strut 72. The longitudinal flexibility of such a tubular can be modified by changing the length of the cells and by connecting each row of cells with a compliant link. Further, the force deflection characteristics and the longitudinal flexibility can also be altered by the design of the cell shape. FIG. 6A illustrates an expandable bistable tubular 70 in its expanded configuration while FIG. 4B illustrates the expandable bistable tubular 70 in its contracted or collapsed configuration. Within this application the term "collapsed" is used to identify the configuration of the bistable element or device in the stable state with the smallest diameter, it is not meant to imply that the element or device is damaged in any way. In the collapsed state, bistable tubular 70 is readily introduced into a wellbore. Upon placement of the bistable tubular 70 at a desired wellbore location, it is expanded. The geometry of the bistable cells is such that the tubular cross-section can be expanded in the radial direction to increase the overall diameter of the tubular. As the tubular expands radially, the bistable cells deform elastically until a specific geometry is reached. At this point the bistable cells move, e.g. snap, to a final expanded geometry. With some materials and/or bistable cell designs, enough energy can be released in the elastic deformation of the cell (as each bistable cell snaps past the specific geometry) that the expanding cells are able to initiate the expansion of adjoining bistable cells past the critical bistable cell geometry. Depending on the deflection curves, a portion or even an entire length of bistable expandable tubular can be expanded from a single point.

Figure 7:
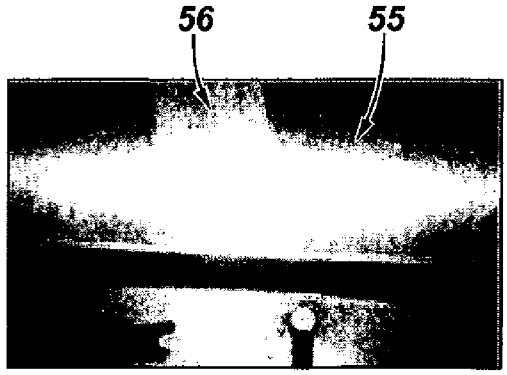
FIG. 7 is a photograph of a process of applying a fibrous filter media to a base pipe.

FIG. 7 is a photograph of one process of applying a fibrous filter media such as that shown in the photograph of FIG. 5, to a base tubular. A first layer 55 is shown already applied, while a second layer 56 is in the process of being applied. Thickness of the layers and their compression can be controlled by tension of the material as it is applied. If desired, a sealant precursor composition could be applied, for example sprayed, during the wrapping process, for example just before each layer is wrapped onto the base tubular. Alternatively, the wrapped tubular may be dipped into a liquid or sprayed to apply a sealant precursor composition. Many alternatives are possible and will be apparent to the ordinary skilled artisan.

Although only a few exemplary embodiments of this invention have been described in detail above, those skilled in the art may readily appreciate that many modifications are possible in the exemplary embodiments without materially departing from the novel teachings and advantages of this invention. Accordingly, all such modifications are intended to be included within the scope of this invention as defined in the following claims. In the claims, no clauses are intended to be in the means-plus-function format allowed by 35 U.S.C. § 112, paragraph 6 unless "means for" is explicitly recited together with an associated function. "Means for" clauses are intended to cover the structures described herein as performing the recited function and not only structural equivalents, but also equivalent structures.

TABLE 1

MeshRite ™ Screens Specifications

| Inner Perforated Pipe | | | | | | | | | | Outer Jacket | | | |
|---|---|---|---|---|---|---|---|---|---|---|---|---|---|
| Size (in. [mm]) | Pipe ID (in. [mm]) | Pipe OD (in. [mm]) | Weight (lbm/ft) | Thread Type | Coupling OD (in. [mm]) | Holes (number per ft) | Hole Diameter (in. [mm]) | Hole Area (in.2/ft [mm2/ft]) | Filter Open Area (%) | Jacket OD (in. [mm]) | Holes (number per ft) | Hole Diameter (in. [mm]) | Hole Area (in.$^2$/ft [mm$^2$/ft]) |
| 0.750 [19.1] | 0.824 [20.9] | 1.050 [26.7] | 0.7 | NPT | 1.313 [33.4] | 74 | 0.250 [6.4] | 3.632 [76.88] | 92 | 1.050 [26.7] | 443 | 0.250 [6.4] | 21.746 [460.29] |
| 1.000 [25.4] | 0.985 [25.0] | 1.614 [41.0] | 0.9 | NPT | 1.614 [41.0] | 63 | 0.313 [8.0] | 4.832 [102.28] | 92 | 1.610 [40.9] | 510 | 0.250 [6.4] | 25.035 [529.91] |
| 1.250 [31.8] | 1.246 [31.6] | 1.865 [47.4] | 0.9 | NPT | 1.865 [47.4] | 74 | 0.313 [8.0] | 5.676 [120.14] | 92 | 1.875 [47.5] | 599 | 0.250 [6.4] | 29.403 [622.36] |
| 1.500 [38.1] | 1.496 [38.0] | 2.126 [54.0] | 1.2 | NPT | 2.126 [54.0] | 86 | 0.313 [8.0] | 6.596 [139.62] | 92 | 2.130 [54.1] | 661 | 0.250 [6.4] | 32.447 [686.79] |
| 2.000 [50.8] | 2.001 [50.8] | 2.630 [66.8] | 1.3 | NPT | 2.630 [66.8] | 86 | 0.313 [8.0] | 6.596 [139.62] | 92 | 2.637 [66.8] | 690 | 0.250 [6.4] | 33.688 [713.06] |
| 2.063 [52.4] | 1.751 [44.5] | 2.063 [52.4] | 3.3 | NU 10 RD | 2.500 [63.5] | 87 | 0.313 [8.0] | 6.673 [141.25] | 92 | 2.800 [71.1] | 703 | 0.250 [6.4] | 34.508 [730.42] |
| 2.375 [60.3] | 1.995 [50.7] | 2.375 [60.3] | 4.6 | NU 10 RD | 2.875 [73.0] | 98 | 0.375 [9.5] | 10.824 [229.11] | 92 | 3.000 [76.2] | 783 | 0.250 [6.4] | 38.435 [813.54] |
| 2.875 [73.0] | 2.441 [62.0] | 2.875 [73.0] | 6.4 | NU 10 RD | 3.500 [88.9] | 110 | 0.375 [9.5] | 12.149 [257.15] | 92 | 3.600 [91.4] | 911 | 0.250 [6.4] | 44.719 [946.55] |

TABLE 1-continued

MeshRite ™ Screens Specifications

| Inner Perforated Pipe | | | | | | | | | | Outer Jacket | | | |
|---|---|---|---|---|---|---|---|---|---|---|---|---|---|
| Size (in. [mm]) | Pipe ID (in. [mm]) | Pipe OD (in. [mm]) | Weight (lbm/ft) | Thread Type | Coupling OD (in. [mm]) | Holes (number per ft) | Hole Diameter (in. [mm]) | Hole Area (in.2/ft [mm2/ft]) | Filter Open Area (%) | Jacket OD (in. [mm]) | Holes (number per ft) | Hole Diameter (in. [mm]) | Hole Area (in.$^2$/ft [mm$^2$/ft]) |
| 3.500 [88.9] | 2.992 [76.0] | 3.500 [88.9] | 9.2 | NU 10 RD | 4.250 [108.0] | 111 | 0.500 [12.7] | 21.795 [461.33] | 92 | 4.200 [106.7] | 1,071 | 0.250 [6.4] | 52.573 [1,112.80] |
| 4.000 [101.6] | 3.548 [90.1] | 4.000 [101.6] | 9.6 | NU 8 RD | 4.750 [120.7] | 122 | 0.500 [12.7] | 23.955 [507.05] | 92 | 4.700 [119.4] | 1,199 | 0.250 [6.4] | 58.856 [1,245.79] |
| 4.500 [114.3] | 4.000 [101.6] | 4.500 [114.3] | 11.0 | STC/ LTC | 5.000 [127.0] | 146 | 0.500 [12.7] | 28.667 [606.78] | 92 | 5.200 [132.1] | 1,327 | 0.250 [6.4] | 65.139 [1,378.78] |
| 5.000 [127.0] | 4.494 [114.1] | 5.000 [127.0] | 15.0 | STC/ LTC | 5.563 [141.3] | 158 | 0.500 [12.7] | 31.023 [656.65] | 92 | 5.700 [144.8] | 1,455 | 0.250 [6.4] | 71.422 [1,511.77] |
| 5.500 [139.7] | 5.012 [127.3] | 5.500 [139.7] | 17.0 | STC/ LTC | 6.050 [153.7] | 172 | 0.500 [12.7] | 33.772 [714.84] | 92 | 6.200 [157.5] | 1,583 | 0.250 [6.4] | 77.705 [1,644.76] |
| 6.625 [168.3] | 5.921 [150.4] | 6.625 [168.3] | 20.0 | STC/ LTC | 7.390 [187.7] | 182 | 0.500 [12.7] | 35.736 [756.41] | 92 | 7.300 [185.4] | 1,872 | 0.250 [6.4] | 91.892 [1,945.05] |
| 7.000 [177.8] | 6.366 [161.7] | 7.000 [177.8] | 23.0 | STC/ LTC | 7.656 [194.5] | 196 | 0.500 [12.7] | 38.485 [814.60] | 92 | 7.700 [195.6] | 1,968 | 0.250 [6.4] | 96.604 [2,044.78] |
| 7.625 [193.7] | 6.969 [177.0] | 7.625 [193.7] | 26.4 | STC/ LTC | 8.500 [215.9] | 204 | 0.500 [12.7] | 40.055 [847.83] | 92 | 8.300 [210.8] | 2,128 | 0.250 [6.4] | 104.458 [2,211.03] |
| 8.625 [219.1] | 7.921 [201.2] | 8.625 [219.1] | 32.0 | STC/ LTC | 9.625 [244.5] | 238 | 0.500 [12.7] | 46.731 [989.14] | 92 | 8.300 [210.8] | 2,640 | 0.250 [6.4] | 129.591 [2,743.01] |
| 9.625 [244.5] | 8.921 [226.6] | 9.625 [244.5] | 36.0 | STC/ LTC | 10.625 [269.9] | 264 | 0.500 [12.7] | 51.836 [1,097.20] | 92 | 10.300 [261.6] | 2,640 | 0.250 [6.4] | 129.591 [2,743.01] |

Note:
IDs and weights of the screen base pipe given above are representative. Other weights are available as required

What is claimed is:

1. A method comprising:

(a) installing a tool in a wellbore, the tool comprising:

a base tubular having a plurality of openings and a longitudinal bore adapted to fluidly connect to a tubular;

a jacket tubular having a second plurality of openings; and an open, lofty, three-dimensional, non-fines stopping fibrous filter medium between the base tubular and the jacket tubular;

the fibrous filter medium selected from woven and non-woven materials comprising primarily organic fibers, primarily inorganic fibers, both organic and inorganic fibers, two or more layers of any of these, and combinations of these, and comprising a sealant precursor composition either fixed to the fibers, in at least some regions between the fibers, or combination thereof; and (b) installing a first packer upstream of the tool and a second packer downstream of the tool.

2. The method of claim 1, comprising triggering the sealant precursor composition, or a component thereof, to form a seal sealing at least a face of the fibrous filter medium when desired, wherein the triggering comprises any one or more techniques selected from mechanical, physical, chemical, thermal, and combinations thereof.

3. The method of claim 2 wherein the triggering mechanism is chemical, and the method comprises flowing one or more triggering compositions into the wellbore to trigger the sealant precursor composition into forming the seal.

4. The method of claim 2 wherein the triggering occurs when a) an unacceptable amount of water is detected at or near the fibrous filter medium; b) when an unacceptable amount of water begins producing from the wellbore; c) a combination of (a) and (b); or for any other reason.

5. The method of claim 2 wherein the triggering is primarily chemical in nature, and comprises conveying a triggering composition to the filter medium via coiled tubing, with or without a communication line accompanying the coiled tubing, either attached to the outside of the coiled tubing, or disposed inside the coiled tubing.

6. The method of claim 5 wherein the triggering composition comprises a triggering component that triggers the sealant precursor composition or a component thereof to form the seal.

7. The method of claim 5 wherein the triggering composition and sealant precursor composition are independently selected from solids, liquids, gases, and combinations thereof, as long as the sealant precursor composition is able to be triggered by the triggering composition.

8. The method of claim 5 wherein the triggering composition and sealant precursor composition are independently selected from organic chemicals, inorganic chemicals, and any combinations thereof; wherein the organic chemicals are selected from monomers, oligomers, polymers, crosslinked polymers, and combinations thereof; wherein the polymers are selected from thermoplastic, thermosetting, moisture setting, and elastomeric polymers, any of which may comprise one or more inorganic ingredients; and wherein the inorganic chemicals are selected from metals, alkaline and alkaline earth chemicals, minerals, and combinations thereof.

9. The method of claim 5 wherein the physical nature of the triggering composition and sealant precursor composition are independently selected from any morphology selected from coatings, foamed, gelled, slurried, powdered, and combinations thereof.

10. The method of claim 5 comprising reacting the triggering composition with the sealant precursor composition to cause a chemical change of either composition, wherein the sealant precursor composition alone or in reactive or physical combination with the triggering composition, causes or results in the seal.

11. The method of claim 1 wherein the tool does not comprise a wire-wrapped screen.

12. The method of claim 1 wherein the fibrous filter media is selected from any fibrous material having porosity sufficient to pass wellbore fluids and treatment fluids therethrough without significant plugging, that does not stop particle fines, and that is capable of serving as a base for the sealant precursor composition.

13. The method of claim 1 wherein the fibrous filter media comprises nonwoven steel fibers or ribbons.

14. The method of claim 1 wherein the sealant precursor composition is adhered to the fibers using a separate adhesive composition, coated onto the fibers neat or in combination with a coatable or sprayable binder, magnetically held onto the fibers, or otherwise supported by the fibers of the fibrous filter media in such as way that the sealant precursor composition does not easily come lose from the fibers, but is able to itself interact with, or cause a sealing component of the sealant precursor composition to interact with, a triggering mechanism.

15. The method of claim 1 comprising independently selecting size, shape, and configuration of the plurality of openings in the base tubular, and the plurality of openings in the jacket tubular.

16. The method of claim 1 wherein the installing of the tool comprises using a conveyance line selected from wireline, slickline, and tubulars.

17. The method of claim 1 comprising conveying a first triggering fluid into the wellbore to trigger a first portion of the sealant precursor composition to seal, followed by one or more subsequent fluids to triggered another portion of the sealant precursor composition to seal, wherein the first and subsequent fluids differ in one or more parameters selected from composition, concentration, viscosity, temperature, density, ratio of solid to liquid, and acidity (pH).

18. A method comprising:

(a) installing a tool in a wellbore, the tool comprising:

a base tubular having a plurality of openings and a longitudinal bore adapted to fluidly connect to a tubular;

a jacket tubular having a second plurality of openings; and an open, lofty, three-dimensional, non-fines stopping fibrous filter medium between the base tubular and the jacket tubular;

(b) installing a first packer upstream of the tool and a second packer downstream of the tool; and (c) monitoring the status of the wellbore in the vicinity of the fibrous filter medium for an unacceptable amount of water or other condition making desirable the triggering of the sealant precursor composition to form the seal.

19. A system comprising:

(a) a wellbore tool comprising (i) a base tubular having a plurality of openings and a longitudinal bore adapted to be fluidly connected to a tubular; (ii) a jacket tubular having a second plurality of openings; and (iii) an open, lofty, three-dimensional, non-fines stopping fibrous filter medium between the base tubular and the jacket tubular; and;

(b) a downstream and an upstream packer, the packers adapted to isolate the wellbore tool in a zone of a wellbore wherein the open, lofty, three-dimensional, non-fines stopping fibrous filter medium comprises is selected from woven materials and nonwoven materials, and wherein the woven and the nonwoven materials comprise primarily organic fibers, primarily inorganic fibers, both organic and inorganic fibers, two or more layers of any of these, and combinations of these; and wherein the system further comprises a sealant precursor composition either fixed to the fibers, in at least some regions between the fibers, or combination thereof.

20. The system of claim 19 wherein the wherein the fibrous filter media is selected from any fibrous material having porosity sufficient to pass wellbore fluids and treatment fluids therethrough without significant plugging, that does not stop particle fines, and that is capable of serving as a base for the sealant precursor composition.

21. The system of claim 19 wherein the wherein the fibrous filter media has a permeability greater than 700 darcies and a porosity ranging from about 85 percent to about 95 percent.

22. The system of claim 19 wherein the fibrous filter media comprises steel fibers and has a permeability greater than 700 darcies and a porosity ranging from about 85 percent to about 95 percent.

* * * * *